US009286844B2

(12) United States Patent
Zhu

(10) Patent No.: US 9,286,844 B2
(45) Date of Patent: Mar. 15, 2016

(54) LC PANEL HAVING SWITCH UNIT, AND LCD DEVICE HAVING SWITCH UNIT

(71) Applicant: SHENZHEN CHINA STAR OPTOELECTRONICS TECHNOLOGY CO., LTD, Shenzhen (CN)

(72) Inventor: Jiang Zhu, Shenzhen (CN)

( * ) Notice: Subject to any disclaimer, the term of this patent is extended or adjusted under 35 U.S.C. 154(b) by 186 days.

(21) Appl. No.: 14/111,546

(22) PCT Filed: Jul. 11, 2013

(86) PCT No.: PCT/CN2013/079202
§ 371 (c)(1),
(2) Date: Oct. 12, 2013

(87) PCT Pub. No.: WO2015/003361
PCT Pub. Date: Jan. 15, 2015

(65) Prior Publication Data

US 2015/0015471 A1 Jan. 15, 2015

(30) Foreign Application Priority Data

Jul. 9, 2013 (CN) ..... 2013 1 0286902

(51) Int. Cl.
*G09G 3/36* (2006.01)

(52) U.S. Cl.
CPC ..... *G09G 3/3648* (2013.01); *G09G 3/3614* (2013.01); *G09G 3/3688* (2013.01); *G09G 2300/043* (2013.01); *G09G 2330/021* (2013.01)

(58) Field of Classification Search
CPC ..... G09G 3/3688
USPC ..... 345/100
See application file for complete search history.

(56) References Cited

U.S. PATENT DOCUMENTS

2005/0024547 A1 2/2005 Park
2006/0262071 A1* 11/2006 Shieh ..... G09G 3/3677 345/100
2006/0274013 A1 12/2006 Lin et al.
2007/0046601 A1* 3/2007 Shin ..... G09G 3/3607 345/89
2010/0007810 A1 1/2010 Nakamura
2011/0248985 A1 10/2011 Lin et al.

FOREIGN PATENT DOCUMENTS

CN 1691101 A 11/2005
CN 101135787 A 3/2008

(Continued)

OTHER PUBLICATIONS

Li Hui, the International Searching Authority written comments, Apr. 2014, CN.

*Primary Examiner* — Roy Rabindranath

(57) ABSTRACT

A liquid crystal panel includes a plurality of thin film transistors (TFTs), scan lines, data lines, a scan driving chip, and a data driving chip. The scan driving chip includes a compensation driving unit coupled to the scan lines. The compensation driving unit drives the TFTs corresponding to a next-row of scan line to turn on when the scan driving chip drives the TFTs corresponding to a current-row of scan line to turn on or after the scan driving chip drives the TFTs corresponding to the current-row of scan line to turn on. The compensation driving unit drives the TFTs corresponding to the next-row of scan line to turn off when the TFTs corresponding to the current-row of scan line receive a data signal of the data driving chip or before the TFTs corresponding to the current-row of scan line receive the data signal of the data driving chip.

8 Claims, 4 Drawing Sheets

(56) References Cited

FOREIGN PATENT DOCUMENTS

| | | | |
|---|---|---|---|
| CN | 101598879 | A | 12/2009 |
| CN | 101609651 | A | 12/2009 |
| CN | 102054456 | A | 5/2011 |
| CN | 102346341 | A | 2/2012 |
| CN | 102347327 | A | 2/2012 |
| CN | 102779492 | A | 11/2012 |

* cited by examiner

LC PANEL HAVING SWITCH UNIT, AND LCD DEVICE HAVING SWITCH UNIT

This application is a national stage application of PCT application PCT/CN2013/079202 filed on Jul. 11, 2013, which is based on and claims priority to Chinese patent application 201310286902.1 filed on Jul. 9, 2013 in China. The entirety of each of the above-mentioned applications is hereby incorporated by reference herein in its entirety.

TECHNICAL FIELD

The present disclosure relates to the field of liquid crystal displays (LCDs), and more particularly to a liquid crystal (LC) panel, an LCD device, and a method for driving the LC panel.

BACKGROUND

A liquid crystal display (LCD) device includes a liquid crystal (LC) panel, and a backlight unit that provides a light source for the LC panel. The LC panel includes a plurality of thin film transistors (TFTs), scan lines, and data lines. The data lines and the scan lines crisscross with each other. Each of the scan lines controls gate electrodes of one row of TFTs, each of the data lines is connected with source electrodes of one column of TFTs, and a drain electrode of each of the TFTs is connected with one pixel electrode to form a pixel capacitor. The pixel capacitor includes the pixel electrode and a common electrode, which are opposite to each other. The pixel electrode is connected with the drain electrode of each of the TFTs, and a constant voltage signal is generally sent to the common electrode. LC molecules are filled between the pixel electrode and the common electrode, and a voltage difference between the pixel electrode and the common electrode may be controlled by adjusting an output voltage of the data line, thus deflection angle of the LC molecules can be adjusted, which controls luminous flux.

In order to avoid irreversible damage of the LC molecules by a constant electric field, a polarity inversion method is used for driving the LC panel, namely voltage inversion of the data lines is controlled, and the voltage difference between the pixel electrode and the common electrode is constant. Even though direction of the LC molecules changes with an inversion of the electric field, deflection angle of the LC molecules keeps constant, thus, display effect of the LC panel is not affected. The polarity inversion method includes a row inversion, a column inversion, and a dot inversion. Display effect of the LC panel is best when the dot inversion is used for driving the LC panel. However, LC pixel voltage of the LC panel driven by the dot inversion method continually changes between a positive pixel voltage and a negative pixel voltage, thus, power loss of the dot inversion method is great. Additionally, the data lines and the pixel capacitors have great capacitance, thus, power loss of the data driving circuit is mainly in an entire driving circuit. Therefore, how to reduce dynamic power loss of the data driving circuit is an important concern.

SUMMARY

In view of the above-described problems, the aim of the present disclosure is to provide a liquid crystal (LC) panel, a liquid crystal display (LCD) device, and a method for driving the LC panel capable of reducing power loss, where the LC panel is driven by using a dot inversion method, and the LCD device comprises the LC panel driven by using the dot inversion method.

The aim of the present disclosure is achieved by the following methods.

An LC panel comprises a plurality of thin film transistors (TFTs), scan lines, data lines, a scan driving chip that drives the scan lines, and a data driving chip that drives the data lines. The data lines and the scan lines crisscross with each other. Gate electrodes of each row of TFTs are connected with one scan line, source electrodes of each column of TFTs are connected with one data line, and a drain electrode of each of the TFTs is connected with a pixel electrode. The scan driving chip comprises a compensation driving unit coupled to the scan lines.

The compensation driving unit drives the TFTs corresponding to a next-row of scan line to turn on when the scan driving chip drives the TFTs corresponding to a current-row of scan line to turn on or after the scan driving chip drives the TFTs corresponding to the current-row of scan line to turn on. The compensation driving unit drives the TFTs corresponding to the next-row of scan line to turn off when the TFTs corresponding to the current-row of scan line receive a data signal of the data driving chip or before the TFTs corresponding to the current-row of scan line receive the data signal of the data driving chip. After the current-row of scan line has been driven, the scan driving chip drives the TFTs corresponding to the next-row of scan line to turn on, which is kept for one scanning interval, and then the TFTs corresponding to the next-row of scan line turn off. Time of driving each of the scan lines is one scanning interval in one frame picture of the LC panel.

Furthermore, the LC panel further comprises a first switch unit, and a control end of the first switch unit is coupled to a first driving unit. The first switch unit is connected between adjacent data lines. The first driving unit drives the first switch unit to turn on when the scan driving chip drives the TFTs corresponding to the current-row of scan line to turn on or after the scan driving chip drives the TFTs corresponding to the current-row of scan line to turn on. The first driving unit drives the first switch unit to turn off when the TFTs corresponding to the current-row of scan line receive the data signal of the data driving chip or before the TFTs corresponding to the current-row of scan line receive the data signal of the data driving chip. The present disclosure uses the first switch unit. When the first switch unit turns on, two adjacent data lines are electrically connected with each other, thus, the charge of the pixel capacitors corresponding to the TFTs connected with the same row of scan line also can be shared with each other. Namely, the charge of any one of the pixel capacitors corresponding to the current-row of scan line not only shares with the charge of the pixel capacitor corresponding to the same column of data line, but also shares with the charge of the pixel capacitor corresponding to the same row of scan line. Thus, the pixel capacitor may be loaded more charges in the same time, namely few charges are loaded to the original positive capacitor by the data driving chip to transform a positive capacitor to a negative capacitor, thereby reducing power loss of the data driving circuit.

Furthermore, the first switch unit is connected between each of the data lines and one of the adjacent data lines. A number of the data line are supposed to be N, if the first switch unit is connected between any two adjacent data lines, N−1 first switch units are needed. However, in the present disclosure, the number of the first switch unit may be a half of N−1.

The first switch unit and the first driving unit themselves need to loss power, thus, the present disclosure reduces cost and energy consumption.

Furthermore, a second switch unit is connected between each of the data lines and the data driving chip, and a control end of the second switch unit is coupled to a second driving unit. The second driving unit drives the second switch unit to turn on after a preset delay time when the scan driving chip drives the TFTs corresponding to the current-row of scan line to turn on or after the scan driving chip drives the TFTs corresponding to the current-row of scan line to turn on. The next-row of scan line drives the corresponding TFTs to turn off when the preset delay time ends or before the preset delay time ends. The second switch unit is used for controlling the output of the data signal without changing the original data driving chip of the present disclosure, which is easy to adjust time of sharing charges between the pixel electrodes, thereby increasing reusability of the circuit.

The present disclosure provides a method for driving the LC panel, where the LC panel comprises a plurality of the TFTs, the scan lines, the data lines, the scan driving chip that drives the scan lines, and the data driving chip that drives the data lines. The data lines and the scan lines crisscross with each other. Gate electrode of each row of TFTs are connected with one scan line, source electrodes of each column of TFTs are connected with one data line, and the drain electrode of each of the TFTs is connected with the pixel electrode. The method for driving the LC panel comprises:

step A: controlling the scan driving chip to drive the TFTs corresponding to the current-row of scan line to turn on;

step B: controlling the scan driving chip to drive the TFTs corresponding to the next-row of scan line to turn on; and step C: determining whether the TFTs corresponding to the current-row of scan line receive the data signal, and driving the TFTs corresponding to the next-row of scan line to turn off when the TFTs corresponding to the current-row of scan line receive the data signal of the data driving chip or before the TFTs corresponding to the current-row of scan line receive the data signal of the data driving chip.

Furthermore, the first switch unit is connected between adjacent data lines. The step B further comprises: controlling the first switch unit to turn on. The step C further comprises: determining whether the TFTs corresponding to the current-row of scan line receive the data signal of the data driving chip, and controlling the first switch unit to turn off when the TFTs corresponding to the current-row of scan line receive the data signal or before the TFTs corresponding to the current-row of scan line receive the data signal of the data driving chip. The present disclosure uses the first switch unit. When the first switch unit turns on, two adjacent data lines are electrically connected with each other, thus, the charge of the pixel capacitors corresponding to the TFTs connected with the same row of scan line also can be shared with each other. Namely, the charge of any one of the pixel capacitor corresponding to the current-row of scan line not only shares with the charge of the pixel capacitor corresponding to the same column of data line, but also shares with the charge of the pixel capacitor corresponding to the same row of scan line. Thus, the pixel capacitor may be loaded more charges in the same time, namely few charges are loaded to the original positive capacitor by the data driving chip to transform a positive capacitor to a negative capacitor, thereby reducing power loss of the data driving circuit.

Furthermore, the step B further comprises: controlling the first switch unit to turn on, and controlling the scan driving chip to drive the TFTs corresponding to the next-row of scan line to turn on after the first switch unit turns off. Charges of the pixel capacitors corresponding to the same row of scan line are shared with each other, then charges of the pixel capacitors corresponding to the same column of data line are shared with each other.

Furthermore, the step B further comprises: controlling the scan driving chip to drive the TFTs corresponding to the next-row of scan line to turn on, and controlling the first switch unit to turn on after the scan driving chip drives the TFTs corresponding to the next-row of scan line to turn on. Charges of the pixel capacitors corresponding to the same column data line are shared with each other, then charges of the pixel capacitors corresponding to the same row of scan line are shared with each other. Or, the step B further comprises: controlling the scan driving chip to drive the TFTs corresponding to the next-row of scan line to turn on, and simultaneously controlling the first switch unit to turn on. Charges of the pixel capacitors corresponding to the same column data line are shared with each other, at same time, charges of the pixel capacitors corresponding to the same row of scan line are shared with each other. Each of the pixel capacitors obtains charge from two groups of pixel capacitors, thereby obtaining more charges in the same time and increasing charge speed.

Furthermore, wherein a second switch unit is connected between each of the data lines and the data driving chip. The method further comprises a step A1 before the step A comprising: controlling the second switch unit to turn off. The step C comprises: controlling the second switch unit to turn on after the preset delay time, and determining whether the TFTs corresponding to the current-row of scan line receive the data signal of the data driving chip. The second switch unit is used for controlling the output of the data signal without changing the original data driving chip of the present disclosure, which is easy to adjust time of sharing charges between the pixel electrodes, thereby increasing reusability of the circuit.

The LC panel comprises the scan lines, the data lines, the scan driving chip that drives the scan lines, and the data driving chip that drives the data lines. The data lines and the scan lines crisscross with each other. The scan driving chip comprises the compensation driving unit coupled to the scan lines. Time of driving each of the scan lines is one scanning interval in one frame picture of the LC panel. The compensation driving unit outputs a first driving signal and a second driving signal in one scanning interval of each of the scan lines. The first driving signal and the second driving signal drive the TFTs to turn on. The compensation driving unit outputs the first driving signal of the next-row of scan line when the compensation driving unit outputs the second driving signal of the current-row of scan line or after the compensation driving unit outputs the second driving signal of the current-row of scan line. And the compensation driving unit terminates output of the first driving signal of the next-row of scan line when the TFTs corresponding to the current-row of scan line receive the data signal of the data driving chip or before the TFTs corresponding to the current-row of scan line receive the data signal of the data driving chip. When output of the second driving signal of the current-row of scan line is terminated, the compensation driving unit outputs the second driving signal of the next-row of scan line.

The scan driving chip is configured with the compensation driving unit of the present disclosure. The compensation driving unit drives the TFTs corresponding to the next-row of scan line (the TFTs corresponding to the next-row of scan line is regarded as a second TFT) to turn on (namely the first driving signal of the next-row of scan line is output) when the scan driving chip drives the TFTs corresponding to the current-row of scan line (the TFTs corresponding to the current-row of scan line is regarded as a first TFT) to turn on or after the scan driving chip drives the TFTs corresponding to the current-row of scan line to turn on. At this time, the first TFT and the second TFT are on, a first pixel capacitor is formed between the pixel electrode connected with the first TFT and the common electrode (the first pixel capacitor is supposed as a positive capacitor), and a second pixel capacitor is formed between the pixel electrode connected with the second TFT and the common electrode (the second pixel capacitor is supposed as a negative capacitor). The positive capacitor is electrically connected with the negative capacitor through a same data line, and charge of the positive capacitor and charge of the negative capacitor are shared with each other, which lowers voltage of the positive capacitor and increases voltage of the negative capacitor. When the second TFT turns off (namely output of the first driving signal of the next-row of scan line is terminated), the data signal of the data driving chip is sent to the positive electrode through the first TFT. According to characteristics of the dot inversion, original positive capacitor needs to be transformed to the negative capacitor, the voltage of the original positive capacitor reduces because of sharing the charge, thus, the data driving chip only needs to load few charges to transform the original positive capacitor to the negative capacitor, thereby reducing power loss of the data driving circuit. Additionally, scan time of each of the scan lines is short in one frame picture, and the data signal is sent after the charge is shared, thus, the LC molecules can be rapidly positioned at a preset dip angle, which improves response speed of the LC molecules and display quality of the LC panel.

DETAILED DESCRIPTION

Figure 1:
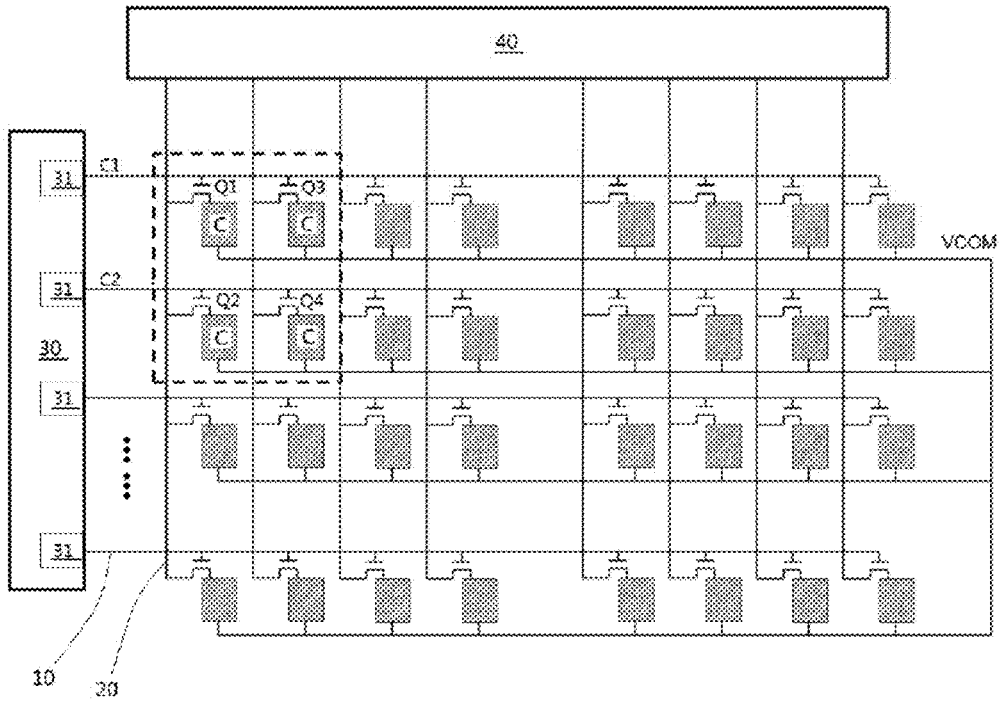
FIG. 1 is a schematic diagram of a liquid crystal (LC) panel of the present disclosure.

The present disclosure provides a liquid crystal display (LCD) device that comprises a liquid crystal (LC) panel and a backlight unit. As shown in FIG. 1, the LC panel comprises a plurality of thin film transistors (TFTs), scan lines 10, data lines 20, a scan driving chip 30 that drives the scan lines 10, and a data driving chip 40 that drives the data lines 20. The data lines and the scan lines crisscross with each other. Gate electrodes of each row of TFTs are connected with one scan line 10, source electrodes of each column of TFTs are connected with one data line 20, and a drain electrode of each of the TFTs is connected with a pixel electrode. A pixel capacitor is formed between the pixel electrode and a common electrode. The scan driving chip 30 comprises a compensation driving unit 31 coupled to the scan lines 10. The compensation driving unit 31 drives the TFTs corresponding to a next-row of scan line C2 to turn on when the scan driving chip 30 drives the TFTs corresponding to a current-row of scan line C1 to turn on or after the scan driving chip 30 drives the TFTs corresponding to the current-row of scan line C1 to turn on. The compensation driving unit 31 drives the TFTs corresponding to the next-row of scan line C2 to turn off when the TFTs corresponding to the current-row of scan line C1 receive a data signal of the data driving chip or before the TFTs corresponding to the current-row of scan line C1 receive the data signal of the data driving chip.

Time of driving each of the scan lines is one scanning interval in one frame picture of the LC panel. After the current-row of scan line C1 has been driven, the scan driving chip drives the TFTs corresponding to the next-row of scan line C2 to turn on, which is kept for one scanning interval, and then the TFTs corresponding to the scan line C2 turns off.

In a typical scan driving circuit, the scan driving chip outputs a driving signal within one scanning interval in one frame picture. However, in the present disclosure, the compensation driving unit outputs a first driving signal and a second driving signal in one scanning interval of each of the scan lines, the first driving signal and the second driving signal drive the TFTs to turn on. The compensation driving unit outputs the first driving signal of the next-row of scan line C2 when the compensation driving unit outputs the second driving signal of the current-row of scan line or after the compensation driving unit outputs the second driving signal of the current-row of scan line, and the compensation driving unit terminates output of the first driving signal of the next-row of scan line C2 when the TFTs corresponding to the current-row of scan line C1 receive the data signal of the data driving chip or before the TFTs corresponding to the current-row of scan line C1 receive the data signal of the data driving chip. When output of the second driving signal of the current-row of scan line C1 is terminated, the compensation driving unit 31 outputs the second driving signal of the next-row of scan line.

To be specific, charge of the current-row of scan line shares with charge of the next-row of scan line within a time from each of the scan lines turning on the corresponding TFTs to the TFTs receiving the data signal. It should be considered that each of two scan lines are regarded as a group, charge of a first scan line of one group shares with charge of a second scan line of the one group within a time from the first scan line of the one group turning on the corresponding TFTs to the TFTs receiving the data signal, when the second row of scan line of the one group drives the corresponding TFTs to turn on, the data signal is directly loaded and the charge is not shared.

The scan driving chip is configured with the compensation driving unit of the present disclosure. The compensation driving unit drives the TFTs corresponding to the next-row of scan line (the TFTs corresponding to the next-row of scan line is regarded as a second TFT) to turn on (namely the first driving signal of the next-row of scan line is output) when the scan driving chip drives the TFTs corresponding to the current-row of scan line (the TFTs corresponding to the current-row of scan line is regarded as a first TFT) to turn on or after the scan driving chip drives the TFTs corresponding to the current-row of scan line to turn one. At this time, the first TFT and the second TFT are on, a first pixel capacitor is formed between the pixel electrode connected with the first TFT and the common electrode (the first pixel capacitor is supposed as a positive capacitor), and a second pixel capacitor is formed between the pixel electrode connected with the second TFT and the common electrode (the second pixel capacitor is supposed as a negative capacitor). The positive capacitor is electrically connected with the negative capacitor through a same data line, and charge of the positive capacitor and charge of the negative capacitor are shared with each other, which lowers voltage of the positive capacitor and increases voltage of the negative capacitor. When the second TFT turns off (namely output of the first driving signal of the next-row of scan line is terminated), the data signal of the data driving chip is sent to the positive electrode through the first TFT. According to characteristics of the dot inversion, original positive capacitor needs to be transformed to the negative capacitor, the voltage of the original positive capacitor reduces because of sharing the charge, thus, the data driving chip only needs to load few charges to transform the original positive capacitor to the negative capacitor, thereby reducing power loss of the data driving circuit. Additionally, scan time of each of the scan lines is short in one frame picture, and the data signal is sent after the charge is shared, thus, the LC molecules can be rapidly positioned at a preset dip angle, which improves response speed of the LC molecules and display quality of the LC panel.

The present disclosure will further be described in detail in accordance with the figures and the exemplary examples.

EXAMPLE 1

Figure 2:
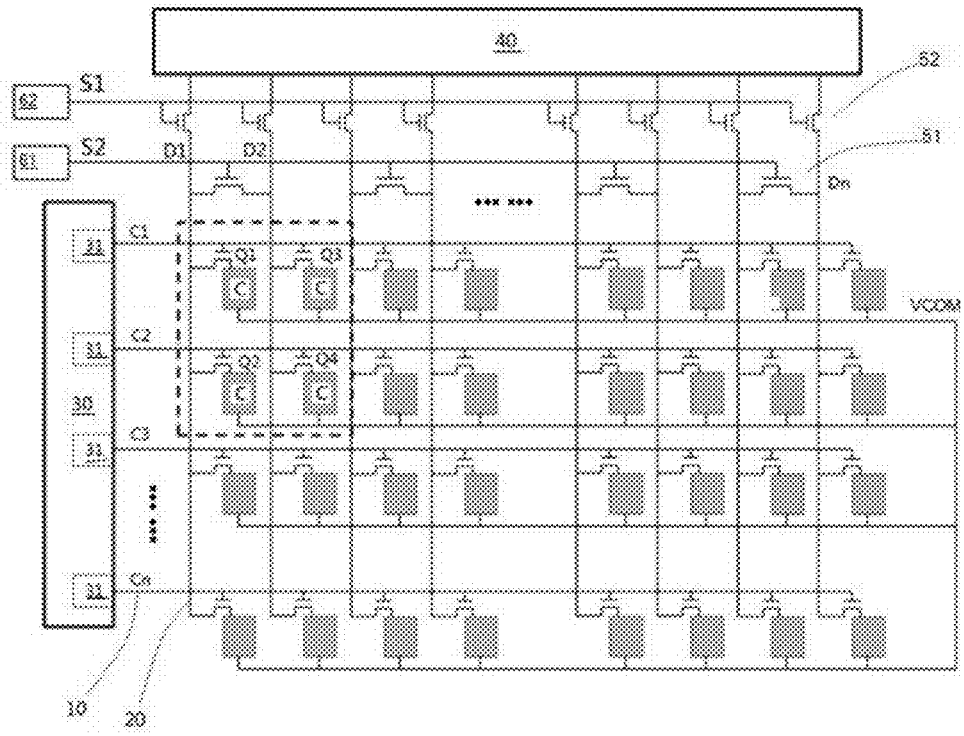
FIG. 2 is a schematic diagram of a liquid crystal (LC) panel of a first example of the present disclosure.

As shown in FIG. 2, the LC panel comprises the plurality of thin film transistors (TFTs), the scan lines 10, the data lines 20, the scan driving chip 30 that drives the scan lines 10, and the data driving chip 40 that drives the data lines 20. The data lines and the scan lines crisscross with each other. The gate electrodes of each row of TFTs are connected with one scan line 10, the source electrodes of each column of TFTs are connected with one data line 20, and the drain electrode of each of the TFTs is connected with the pixel electrode. The scan driving chip 30 comprises the compensation driving unit 31 coupled to the scan lines 10.

The compensation driving unit 31 drives the TFTs corresponding to the next-row of scan line C2 to turn on when the scan driving chip 30 drives the TFTs corresponding to the current-row of scan line C1 to turn on or after the scan driving chip 30 drives the TFTs corresponding to the current-row of scan line C1 to turn on. The compensation driving unit 31 drives the TFTs corresponding to the next-row of scan line C2 to turn off when the TFTs corresponding to the current-row of scan line C1 receive the data signal of the data driving chip 40 or before the TFTs corresponding to the current-row of scan line C1 receive the data signal of the data driving chip 40. After the current-row of scan line C1 has been driven, the scan driving chip drives the TFTs corresponding to the next-row of scan line C2 to turn on, which is kept for one scanning interval, and then the TFTs corresponding to the scan C2 line turn off. Time of driving each of the scan lines is one scanning interval in one frame picture of the LC panel.

A first switch unit 51 is connected between adjacent data lines 20, where a control end of the first switch unit 51 is coupled to a first driving unit 61. The first driving unit 61 drives the first switch unit 51 to turn on when the scan driving chip 30 drives the TFTs corresponding to the current-row of scan line C1 to turn on or after the scan driving chip 30 drives the TFTs corresponding to the current-row of scan line C1 to turn on. The first driving unit 61 drives the first switch unit 51 to turn off when the TFTs corresponding to the current-row of scan line C1 receive the data signal of the data driving chip 40 or before the TFTs corresponding to the current-row of scan line C1 receive the data signal of the data driving chip 40. When the first switch unit 51 turns on, the adjacent data lines 20 are electrically connected with each other, thus, the charges of the pixel capacitors corresponding to the TFTs connected with the same row of scan line 10 also can be shared with each other. Namely, the charge of the pixel capacitor corresponding to the first TFT Q1 not only shares with the charge of the pixel capacitor corresponding to the second TFT Q2, but also shares with the charge of the pixel capacitor corresponding to the third TFT Q3, where the first TFT Q1 and the second TFT Q2 are connected with a same column of data line, the first TFT Q1 and the third TFT Q3 are connected with a same row of scan line. Thus, the pixel capacitor corresponding to the first TFT Q1 may be loaded more charges in the same time, namely few charges are loaded to the original positive capacitor by the data driving chip to transform the positive capacitor to the negative capacitor, thereby reducing power loss of the data driving circuit.

In order to save energy consumption, the first switch unit 51 is connected between each of the data lines 20 and one of the adjacent data lines. A number of the data line are supposed to be N, if the first switch unit 51 is connected between any two adjacent data lines, N−1 first switch units 51 are needed. However, in the present disclosure, the number of the first switch unit 51 may be a half of N−1. The first switch unit 51 and the first driving unit 61 themselves need to loss power, thus, the present disclosure reduces cost and energy consumption.

The data signal outputted by the data driving chip 40 is continuous. Time interval does not exist between the data signals of two TFTs corresponding to two adjacent scan lines 10. In order to provide time for sharing charges, the present disclosure may change output time sequence of the data driving chip 40 and add the interval time between two adjacent data signals. However, the data driving chip 40 needs to be redesigned, which increases design difficulty and design cost.

The first example uses an external circuit of the data driving chip to add the interval time between two adjacent data signals. To be specific, a second switch unit 52 is connected between each of the data lines 20 and the data driving chip, where a control end of the second switch unit 52 is coupled to a second driving unit 62. The second driving unit 62 drives the second switch unit 52 to turn on at a preset delay time when the scan driving chip 30 drives the TFTs corresponding to the current-row of scan line C1 to turn on or after the scan driving chip 30 drives the TFTs corresponding to the current-row of scan line C1 to turn on. The TFTs corresponding to the current-row of scan line C1 receive the data signal of the data driving chip 40 through the second switch unit 52 after the preset delay time. Thus, the second switch unit 52 is used for controlling the output of the data signal without changing original data driving chip, which is easy to adjust time of sharing charges between the pixel electrodes, thereby increasing reusability of the circuit.

EXAMPLE 2

Figure 3:
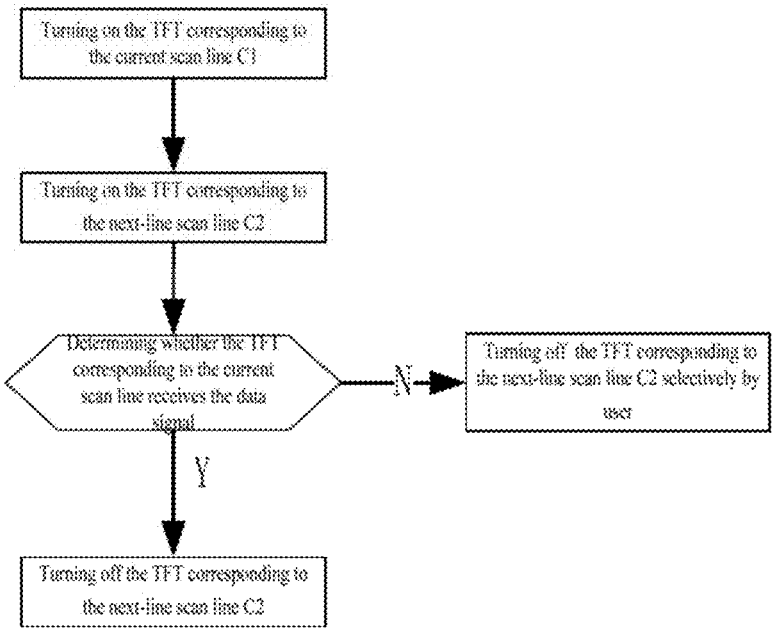
FIG. 3 is a flowchart of a method for driving a liquid crystal (LC) panel of a second example of the present disclosure.

As shown in FIG. 3, the second example provides a method for driving the LC panel, where the LC panel comprises the plurality of TFTs, the scan lines 10, the data lines 20, the scan driving chip 30 that drives the scan lines 10, and the data driving chip 40 that drives the data lines 20. The data lines and the scan lines crisscross with each other. The gate electrodes of each row of TFTs are connected with one scan line 10, the source electrodes of each column of TFTs are connected with one data line 20, and the drain electrode of each of the TFTs is connected with the pixel electrode. The method for driving the LC panel comprises:

step A: controlling the scan driving chip to drive the TFTs corresponding to the current-row of scan line C1 to turn on:

step B: controlling the scan driving chip 30 to drive the TFTs corresponding to the next-row of scan line C2 to turn on; and step C: determining whether the TFTs corresponding to the current-row of scan line receive the data signal D, and driving the TFTs corresponding to the next-row of scan line C2 to turn off when the TFTs corresponding to the current-row of scan line receive the data signal of the data driving chip or before the TFTs corresponding to the current-row of scan line receive the data signal of the data driving chip.

The first switch unit is connected between the adjacent data lines. The step B further comprises: controlling the first switch unit to turn on. The step C further comprises: determining whether the TFTs corresponding to the current-row of scan line receive the data signal of the data driving chip, and controlling the first switch unit to turn off when the TFTs corresponding to the current-row of scan line receive the data signal or before the TFTs corresponding to the current-row of scan line receive the data signal of the data driving chip. When the first switch unit turns on, two adjacent data lines are electrically connected with each other, thus, the charges of the pixel capacitors corresponding to the TFTs connected with the same row of scan line also can be shared with each other. Namely, the charge of any one of the pixel capacitors corresponding to the current-row of scan line not only shares with the charge of the pixel capacitors corresponding to the same column of data line, but also shares with the charge of the pixel capacitors corresponding to the same row of scan line. Thus, the pixel capacitor may be loaded more charges in the same time, namely few charges are loaded to the original positive capacitor by the data driving chip to transform the positive capacitor to the negative capacitor, thereby reducing power loss of the data driving circuit.

When the first switch unit is used, charge of each of the pixel capacitors not only shares with the charge of the pixel capacitor corresponding to the same column of data line, but also shares with the charge of the pixel capacitor corresponding to the same row scan line. Thus, sequencing of sharing charges has many choices, namely the step B has many logical operations as shown below:

1. Sharing charges of the pixel capacitors corresponding to the same row of scan line, and then sharing charges of the pixel capacitors corresponding to the same column data line. The step B comprises: controlling the first switch unit to turn on, and controlling the scan driving chip to drive the TFTs corresponding to the next-row of scan line to turn on after the first switch unit turns off.

Figure 4A:
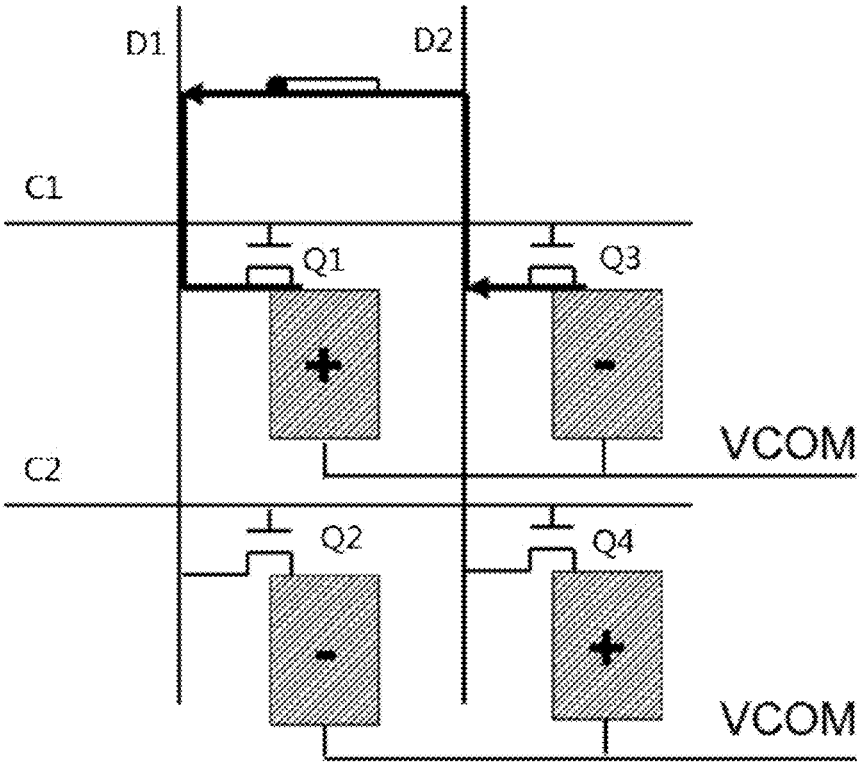
FIG. 4A is a schematic diagram of charge sharing between pixel capacitors corresponding to a same row of scan line of a second example of the present disclosure.
Figure 4B:
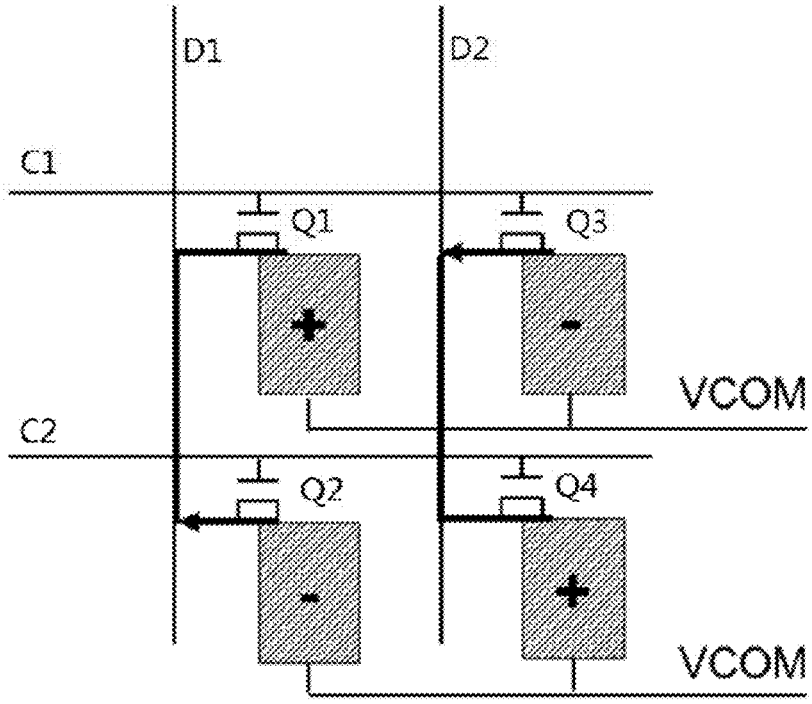
FIG. 4B is a schematic diagram of charge sharing between pixel capacitors corresponding to a same column of data line of a second example of the present disclosure.
Figure 5:
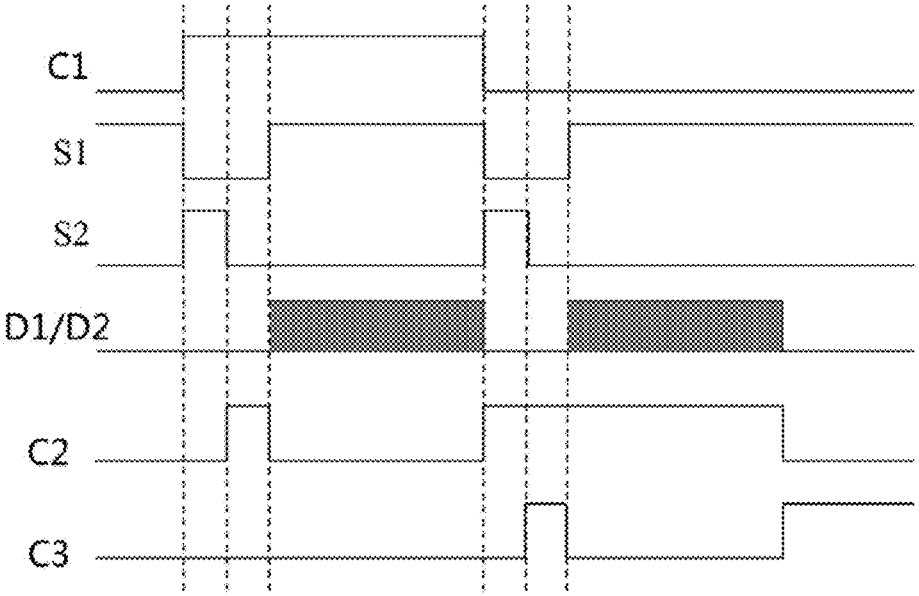
FIG. 5 is a waveform diagram of a first charge sharing between pixel capacitors of a second example of the present disclosure.

After a scan signal is sent to the current-row of scan line, the second driving unit drives the second switch unit to turn off, and the first driving unit drives the first switch unit to turn on. Two adjacent pixel capacitors corresponding to the current-row of scan line store charges having opposite polarity, which are neutralized with each other, as shown in FIG. 4A, the first charge sharing is achieved. The next-row of scan line receives the scan signal, the pixel capacitors corresponding to the same colunm data line share charges with each other, as shown in FIG. 4B, the second charge sharing is achieved. Finally the second switch unit turns on and the first switch unit turns off, and the data driving chip outputs the data signal to the pixel capacitor corresponding to the current-row of scan line through the data lines D1-Dn which is one scan process. In the same way, a third row of scan line provides voltage for the second row of scan line, by that analogy. Specific driving waveform is shown in FIG. 5.

2. Sharing charges of the pixel capacitors corresponding to the same column of data line and then sharing charges of the pixel capacitors corresponding to the same row of scan line. The step B comprises: controlling the scan driving chip to drive the TFTs corresponding to the next-row of scan line to turn on, and controlling the first switch unit to turn on after the scan driving chip drives the TFTs corresponding to the next-row of scan line to turn off.

Figure 6:
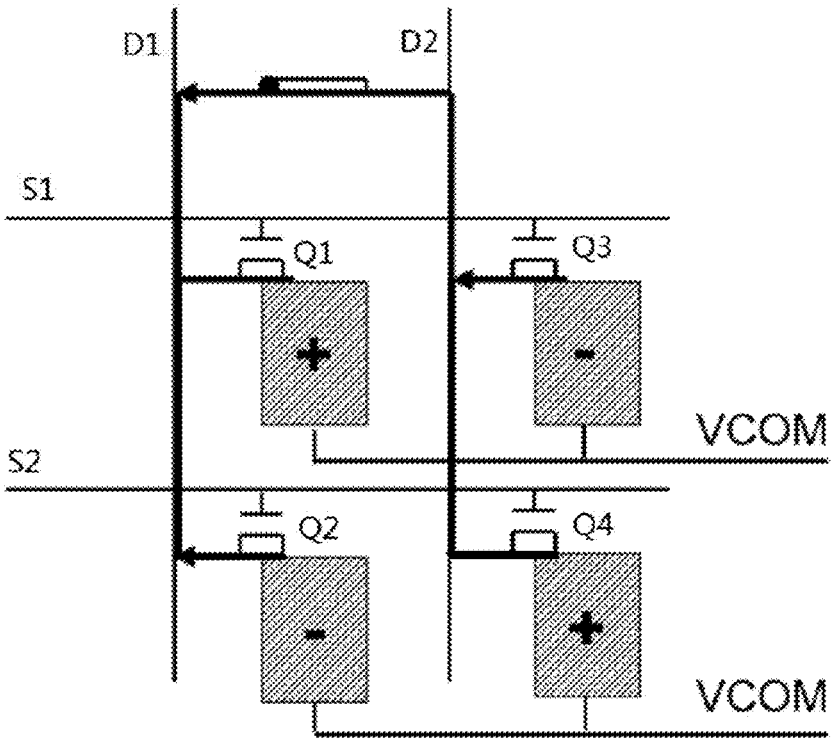
FIG. 6 is a schematic diagram of simultaneous charge sharing among pixel capacitors corresponding to a same column of data line and a same row of scan line of a second example of the present disclosure.
Figure 7:
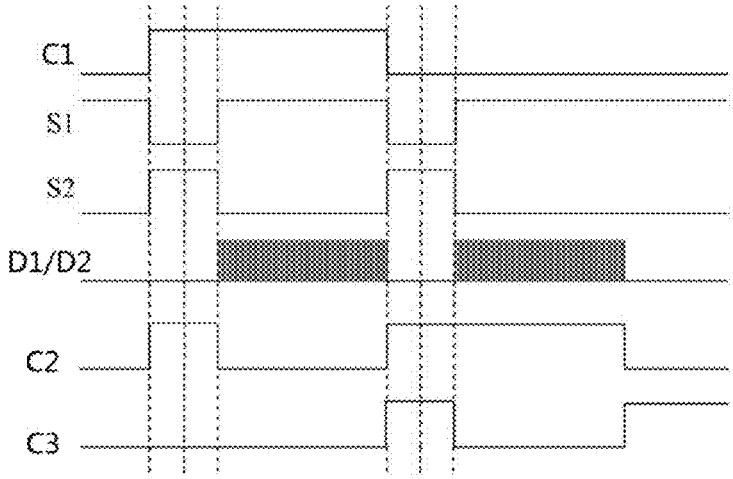
FIG. 7 is a waveform diagram of a second charge sharing between pixel capacitor of a second example of the present disclosure.

3. Sharing charges of the pixel capacitors corresponding to the same column of data line and sharing charges of the pixel capacitors corresponding to the same row of scan line at the same time. As shown in FIG. 6, the step B comprises: controlling the scan driving chip to drive the TFTs corresponding to the next-row of scan line to turn on, and simultaneously controlling the first switch unit to turn on. Each of the pixel capacitor obtains charge from two pixel capacitors, thereby obtaining more charges in the same time and increasing charge speed. An exemplary driving waveform is shown in FIG. 7.

The data signal outputted by the data driving chip is continuous. Time interval does not exist between the data signals of two TFTs corresponding to two adjacent scan lines. In order to provide time for sharing charges, the present disclosure may change output time sequence of the data driving chip and add the interval time between two adjacent data signals. However, the data driving chip needs to be redesigned, which increases design difficulty and design cost.

The second example uses the external circuit of the data driving chip to add the interval time between two adjacent data signals. To be specific, the second switch unit is connected between each of the data lines and the data driving chip, thus, the step A1 is added before the step A: controlling the second switch unit to turn off.

The step C comprises: controlling the second switch unit to turn on after the preset delay time, and determining whether the TFTs corresponding to the current-row of scan line receive the data signal, namely determining whether the TFTs corresponding to the current-row of scan line receive the data signal through determining whether the second switch unit turns on. Thus, the second switch unit is used for controlling the output of the data signal to without changing the original data driving chip, which is easy to adjust time of sharing charges between the pixel electrodes, thereby increasing reusability of the circuit.

The present disclosure is described in detail in accordance with the above exemplary examples. However, this present disclosure is not limited to the exemplary examples. The switch units of the present disclosure may choose controllable semiconductor switches, such as a TFT, a metal-oxide-semiconductor field-effect transistor (MOSFET), a bipolar junction transistor (BJT). On the premise of keeping the conception and the scope of the present disclosure, all modifications, equivalent replacements and improvements, etc. should be considered to belong to the protection scope of the present disclosure.

The invention claimed is:

1. A liquid crystal (LC) panel, comprising:

a plurality of thin film transistors (TFTs);

scan lines;

data lines:

a scan driving chip that drives the scan lines; and a data driving chip that drives the data lines;

wherein the data lines and the scan lines crisscrossed each other; gate electrodes of each row of TFTs are connected with one scan line, source electrodes of each column of TFTs are connected with one data line, and a drain electrode of each of the TFTs is connected with a pixel electrode; the scan driving chip comprises a compensation driving unit coupled to the scan lines;

the compensation driving unit drives the TFTs corresponding to a next-row of scan line to turn on when the scan driving chip drives the TFTs corresponding to a current-row of scan line to turn on or after the scan driving chip drives the TFTs corresponding to the current-row of scan line to turn on; the compensation driving unit drives the TFTs corresponding to the next-row of scan line to turn off when the TFTs corresponding to the current-row of scan line receive a data signal of the data driving chip or before the TFTs corresponding to the current-row of scan line receive the data signal of the data driving chip, wherein a second switch unit is connected between each of the data lines and the data driving chip, and a control end of the second switch unit is coupled to a second driving unit; the second driving unit drives the second switch unit to turn on after a preset delay time when the scan driving chip drives the TFTs corresponding to the current-row of scan line to turn on or after the scan driving chip drives the TFTs corresponding to the current-row of scan line to turn on; the TFTs corresponding to the current-row of scan line receive the data signal of the data driving chip through the second switch unit after the preset delay time; the next-row of scan line drives the corresponding TFTs to turn off when the preset delay time ends or before the preset delay time ends.

2. The LC panel of claim 1, further comprising a first switch unit, and a control end of the first switch unit is coupled to a first driving unit, the first switch unit is connected between adjacent data lines;

wherein the first driving unit drives the first switch unit to turn on when the scan driving chip drives the TFTs corresponding to the current-row of scan line to turn on or after the scan driving chip drives the TFTs corresponding to the current-row of scan line to turn on; the first driving unit drives the first switch unit to turn off when the TFTs corresponding to the current-row of scan line receive the data signal of the data driving chip or before the TFTs corresponding to the current-row of scan line receive the data signal of the data driving chip.

3. The LC panel of claim 2, wherein the first switch unit is connected between each of the data lines and one of the adjacent data lines.

4. A liquid crystal (LC) panel, comprising:

scan lines;

data lines;

a scan driving chip that drives the scan lines; and a data driving chip that drives the data lines;

wherein the data lines and the scan lines crisscross with each other; the scan driving chip comprises a compensation driving unit coupled to the scan lines; time of driving each of the scan lines is one scanning interval in one frame picture of the LC panel; the compensation driving unit outputs a first driving signal and a second driving signal in one scanning interval of each of the scan lines, the first driving signal and the second driving signal drive thin film transistor (TFTs) to turn on;

the compensation driving unit outputs the first driving signal of a next-row of scan line when the compensation driving unit outputs the second driving signal of a current-row of scan line or after the compensation driving unit outputs the second driving signal of the current-row of scan line; and the compensation driving unit terminates output of the first driving signal of the next-row of scan line when the TFTs corresponding to the current-row of scan line receive the data signal of the data driving chip or before the TFTs corresponding to the current-row of scan line receive the data signal of the data driving chip; when output of the second driving signal of the current-row of scan line is terminated, the compensation driving unit outputs the second driving signal of the next-row of scan line.

5. The LC panel of claim 4, wherein a second switch unit is connected between each of the data lines and the data driving chip, and a control end of the second switch unit is coupled to a second driving unit; the second driving unit drives the second switch unit to turn on at a preset delay time when the scan driving chip drives the TFTs corresponding to the current-row of scan line to turn on or after the scan driving chip drives the TFTs corresponding to the current-row of scan line to turn on; the TFTs corresponding to the current-row of scan line receive the data signal of the data driving chip through the second switch unit after the preset delay time; the next-row of scan line drives the corresponding TFTs to turn off when the corresponding TFTs to turn off when the preset delay time ends or before the preset delay time ends.

6. The LC panel of claim 4, further comprising a first switch unit, and a control end of the first switch unit is coupled to a first driving unit, the first switch unit is connected between adjacent data lines;

wherein the first driving unit drives the first switch unit to turn on when the scan driving chip drives the TFTs corresponding to the current-row of scan line to turn on or after the scan driving chip drives the TFTs corresponding to the current-row of scan line to turn on; the first driving unit drives the first switch unit to turn off when the TFTs corresponding to the current-row of scan line receive data sisal of the data driving chip or before the TFTs corresponding to the current-row of scan line receive the data signal of the data driving chip.

7. The LC panel of claim 6, wherein the first switch unit is connected between each of the data lines and one of the adjacent data lines.

8. The LC panel of claim 7, wherein a second switch unit is connected between each of the data lines and the data driving chip, and a control end of the second switch unit is coupled to a second driving unit; the second driving unit drives the second switch unit to turn on at a preset delay time when the scan driving chip drives the TFTs corresponding to the current-row of scan line to turn on or after the scan driving chip drives the TFTs corresponding to the current-row of scan line to turn on; the TFTs corresponding to the current-row of scan line receive the data signal of the data driving chip through the second switch unit after the preset delay time the next-row of scan line drives the corresponding TFTs to turn off when the corresponding TFTs to turn off when the preset delay time ends or before the preset delay time ends.

* * * * *